United States Patent [19]

Milora

[11] Patent Number: 4,521,332

[45] Date of Patent: Jun. 4, 1985

[54] HIGHLY ALKALINE CLEANING DISPERSION

[75] Inventor: David J. Milora, Norristown, Pa.

[73] Assignee: Pennwalt Corporation, Philadelphia, Pa.

[21] Appl. No.: 373,924

[22] Filed: May 3, 1982

Related U.S. Application Data

[63] Continuation of Ser. No. 246,481, Mar. 23, 1981, abandoned, which is a continuation-in-part of Ser. No. 153,489, May 27, 1980, abandoned.

[51] Int. Cl.[3] ..... C11D 3/37; C11D 7/06; C11D 7/16; C11D 7/26

[52] U.S. Cl. ..... 252/527; 134/40; 252/135; 252/156; 252/174.14; 252/174.17; 252/174.18; 252/174.21; 252/174.24; 252/546; 252/DIG. 14

[58] Field of Search ..... 252/135, 156, 527, 546, 252/174.14, 174.17, 174.18, 174.21, 174.24, DIG. 14

[56] References Cited

U.S. PATENT DOCUMENTS

| | | | |
|---|---|---|---|
| 3,085,917 | 4/1963 | Netzler | 134/27 |
| 3,529,999 | 9/1970 | Boeniger | 134/2 |
| 3,579,455 | 5/1971 | Sabatelli | 252/135 |
| 3,583,923 | 6/1971 | Cantrell | 252/110 |
| 3,687,858 | 8/1972 | Geisler | 252/156 |
| 3,965,048 | 6/1976 | Murtaugh | 252/527 |

OTHER PUBLICATIONS

"The Chemical Formulary", vol. XIV, Ed. by H. Bennett, published by Chemical Publishing Co., Inc., New York, 1968, p. 248.

"The Chemical Formulary", vol. XIII, Ed. by H. Bennett, published by Chemical Publishing Co., Inc., New York, 1967, pp. 364 & 365.

COLLOID 112 Technical Bulletin, published by Colloids, Inc., Newark, N.J. 07114, 2 pages.

*Primary Examiner*—Dennis L. Albrecht

[57] ABSTRACT

A highly alkaline aqueous cleaning dispersion comprising sodium hydroxide, a bulking agent such as sodium carbonate and polyacrylic acid dispersing agent is disclosed and claimed. The dispersion when diluted with water is particularly useful in cleaning strip steel after it leaves the rolling mills prior to annealing or coating. A method of preparing the dispersion is also claimed.

8 Claims, No Drawings

HIGHLY ALKALINE CLEANING DISPERSION

This application is a continuation of application Ser. No. 246,481, filed Mar. 23, 1981 which is a continuation-in-part application with respect to U.S. Ser. No. 153,489, filed May 27, 1980, both of which application are now abandoned.

Alkaline cleaners are used prior to many process operations in the production of finished steel. Typical cleaning operations take place prior to batch annealing, continuous annealing, galvanizing, tin plating and/or tin-free steel coating. Alkali contents of these cleaners are normally very high to promote saponification of fatty soils which aids cleaning efficiency and increases the conductivity of these solutions to aid in electrolytic cleaning.

Alkaline cleaners have historically been in dry powder form, with liquid versions having been introduced only in recent years. Liquid cleaners have advantages over the powdered versions such as: the problems of caking or poor flowing from storage bins are minimized; there is no dusting problem in the vicinity of the cleaner use site; safer and cleaner work areas result because of the facility of applying liquids rather than powders; control of additions and concentration maintenance are improved; and there is no dissolving problems at low temperatures during line start-ups or at low temperature operation when dissolved solids may precipitate.

In order for liquid cleaners to be economically attractive, the total solids content of the concentrate should be at least 40% by weight, and preferably higher. This allows the cleaner to contain builders, surfactants, dispersants, or other additives necessary to produce an efficient cleaner. Also, with a highly concentrated liquid product, total consumption of the cleaner in a continuous operation is reduced. These high levels of solids make the concentrated product a dispersion rather than a solution due to their lack of solubility in concentrated caustic solutions.

One of the major problems encountered with liquid dispersion-type cleaners has been separation of the components into layers. This separation occurs after the product is blended and produces heavy sludge at the bottom of a bin or drum and clear liquid at the top, rendering a non-uniform product. In steel mill operations, where partial bins are added at any one time to a cleaning operation, this may produce problems of poor flow from the bins and/or adding the additives in a disproportionate amount or concentration, causing the cleaner to operate at less than desired efficiency.

SUMMARY OF THE INVENTION

I have now discovered a highly alkaline, aqueous cleaning dispersion containing at least 40% total solids by weight which resists separation into layers. The dispersion comprises sodium hydroxide, a bulking agent, such as sodium carbonate, and a polyacrylic acid dispersing agent. Other materials are useful in my composition, such as alkali metal phosphate builders, chelators, and nonionic surfactants. In making the cleaning dispersion, it is necessary to first prepare a saturated neutral or alkaline premix solution to which is added the sodium hydroxide, usually in the form of 50% by weight aqueous sodium hydroxide solution.

DETAILED DESCRIPTION OF INVENTION

The alkali for my alkaline cleaner dispersion is supplied by sodium hydroxide. Preferably, this will be an aqueous solution of sodium hydroxide. Since it is desirable that the concentrate contain the highest content of alkali, this material is usually supplied as a 50% aqueous solution. The sodium hydroxide will vary from 10 to 45% by weight of the cleaning concentrate. When used in my concentrate as a 50% aqueous solution, the sodium hydroxide aqueous solution will range from about 20 to 90% by weight of the concentrate. A preferred concentration of sodium hydroxide as a 50% solution will be about 83% by weight.

My highly alkaline cleaning concentrate is an aqueous dispersion which requires an efficient dispersing agent. I have found that the alkali metal salts of polyacrylic acid having a molecular weight within the range of 500 to 12,000 are efficient dispersing agents.

The polyacrylic acid will disperse the additive ingredients in the aqueous sodium hydroxide and prevent it from separating into layers. The polyacrylic acid salt is present in the cleaning concentrate at a concentration of about 0.04% by weight to a gelling concentration. By "gelling concentration" is meant the concentration at which the dispersion turns into a gel. With a large amount of a highly concentrated sodium hydroxide in the concentrate, the solution will gel at concentration of polyacrylic acid salt at about 0.6% by weight. The overall concentration range of polyacrylic acid salt in my concentrate is about 0.04% to 4% by weight.

The polyacrylic acid is normally supplied as the sodium salt, although the potassium salt, ammonium salt or free acid form could be used, if so desired. As used throughout the specification and claims, the designation "polyacrylic acid" shall mean a homopolymer of acrylic acid having a molecular weight within the range of 500 to 12,000. The alkali metal polyacrylic acid may be purchased under the trademark COLLOID 112 from Colloids, Inc. of Newark, N.J. Another source of alkali metal polyacrylate is sold under the term NOPCOSPERSE 44, sold by Diamond Shamrock Corporation.

It is desirable to have in my highly alkaline aqueous cleaning dispersion an alkali metal phosphate builder. The purpose of the alkali metal phosphate builder is to assist in the cleaning operation, principally as a soil suspending agent. The alkali metal phosphate builder will be present in the cleaning dispersion at a concentration of 0 to 15% by weight. The alkali metal phosphate can be supplied by one or more members selected from the group consisting of sodium hexametaphosphate, sodium tripolyphosphate, tetrapotassium pyrophosphate, tetrasodium pyrophosphate, trisodium phosphate, disodium phosphate, monosodium phosphate, monopotassium phosphate, dipotassium phosphate and tripotassium phosphate.

It is desirable in my cleaning dispersion to have present a nonionic surfactant. The concentration of the nonionic surfactant may vary from 0 to 5% by weight. The nonionic surfactant assists in the cleaning operation and makes it easier for the cleaning liquid to contact the metal surface being cleaned. Nonionic surfactants suitable for use in the strong alkali solutions include ethoxylated alcohols, both linear and branch chained, ethoxylated alkyl phenols, including ethoxylated dialkyl phenols. Examples of linear ethoxylated alcohols are the $C_{12}$ to $C_{15}$ ethoxylated alcohols, as well as the $C_{12}$ to $C_{15}$ branched chain ethoxylated alcohols. The number of ethoxy units will generally vary from 7 to 12 moles of ethylene oxide per mole of alcohol. Examples of the ethoxylated alkyl phenols include the ethoxylated octyl phenols and ethoxylated nonyl phenols. These surfactants generally have 10 to 15 moles of ethylene oxide per mole of phenol. The alkyl substituents in the ethoxylated dialkyl phenols will generally vary from $C_6$ to $C_{12}$ content, and will typically have 10 to 15 moles of ethylene oxide per mole of phenol.

A chelating agent is desirable in my cleaning dispersion to prevent iron, calcium and magnesium salts from precipitating in the cleaner solution and contaminating the work piece in the form of hard water soaps. The gluconates, such as sodium and potassium gluconate, are particularly useful in preventing iron soap formation and redeposition on the work piece. The tetrasodium salt of ethylenediamine tetraacetic acid is particularly useful in preventing calcium and magnesium soap deposits. These metals usually are present in hard water. The chelators useful in my cleaning compositions will be one or more members selected from the group consisting of sorbitol, gluconic acid, glucoheptonic acid, mannitol, ascorbic acid, sorbose, tannic acid, ethylenediamine tetraacetic acid, sodium chrom glucosate, diglycolic acid, aspartic acid, d-gluconolactone, 1-rhamnose, and nitrilotriacetic acid. The chelator will be present at a concentration ranging from about 0 to 3% by weight of the composition. Typically, the chelators will be present at a concentration of 0.25 to 0.50% by weight.

My highly alkaline cleaning dispersion will contain at least about 40% solids by weight in order to be economically attractive due to the high costs of transportation and/or shipping containers. Preferably the solids content can be higher and stable dispersions containing as high as about 48% solids can be prepared in accordance with my invention.

In preparing my highly alkaline cleaning dispersion it is necessary, in order to obtain a non-separating dispersion, that all of the ingredients of the dispersion except the sodium hydroxide be combined in a premix saturated solution. Preferably, the premix solution is added to the sodium hydroxide. For example, if the sodium hydroxide is added to the premix solution the resultant dispersion is less stable. It is also important that the premix be a saturated or nearly saturated solution. If the premix is unsaturated, a less stable dispersion is formed when the premix is combined with the sodium hydroxide.

The premix solution is prepared by mixing the alkali metal phosphate builder, the alkali metal or ammonium salt of polyacrylic acid, the bulking agent, the chelator when used, and water in a mixing vessel with agitation. Before the premix solution is combined with the sodium hydroxide, the premix solution is combined with the sodium hydroxide, the premix should be a saturated solution with a pH of at least 7. If a nonionic is used at a concentration greater than 0.3% by weight the nonionic is preferably added after the saturated premix solution and sodium hydroxide have been combined.

In order to achieve a saturated premix solution, it is necessary that an inorganic salt be supplied which I have called a "bulking agent". The bulking agent acts to build viscosity through the addition of solid particles. In effect, it is another agent to prevent layering of the ingredients. This bulking agent will be one or more members selected from the group consisting of sodium carbonate, potassium carbonate, and any one of the previously mentioned alkali metal phosphate builders. The preferred bulking agent is sodium carbonate. The bulking agent will generally be present as needed to effect a saturated solution at a concentration ranging from about 0.5 to 20% by weight of the cleaning concentrate.

The balance of my highly alkaline dispersion will be water. The water content will generally vary from about 6 to 60% by weight of the cleaning dispersion.

If the alkali metal phosphate builder used in the cleaning dispersion is partially acidic, such as would be the case with the mono alkali metal phosphates or if the acrylic polymer is supplied in the form of the free acid, it is necessary that part of the sodium hydroxide be added to the premix solution to bring its pH to at least 7. This will prevent any carbon dioxide evolving in the event that the preferred bulking agent, sodium carbonate, was used in an acidic premix solution.

After the premix of all of the additives is prepared, the premix should be saturated or nearly saturated aqueous solution having a pH of at least 7. In the preparation of both the premix solution and the final dispersion, agitation is required to bring all of the ingredients into uniform dispersion. Because of the strong alkali present, and possible inclusion of metal chelating agents, it is desirable to prepare the premix and the final cleaning dispersion in a stainless steel vessel.

When the sodium hydroxide solution is combined with the premix solution, heat is liberated. Accordingly, it is preferable that the sodium hydroxide solution be at ambient temperature before the premix solution is added to it in order to prevent any undesired boiling. When the premix solution is added to the sodium hydroxide, a viscous dispersion will occur, which will become uniform as the agitation continues. This may require from ½ to 2 hours.

The highly alkaline cleaning dispersions of my invention are particularly useful in cleaning steel strip which has just left the cold reduction mills. At this point, in the steel-making process, the steel strip will be soiled with rolling oils and other contaminants. In using my highly alkaline aqueous cleaning dispersion, it is generally diluted with water at a concentration of about 1 to 15 ounces of concentrate per gallon of water. The use solution can be used in either electrolyte or non-electrolytic cleaning operations.

The cleaning is generally conducted at a temperature within the range of about 150° F. to 210° F. The cleaning can take place either by moving the steel strip through a cleaning tank containing the cleaning solution, or the cleaning solution can be applied as a spray. After the steel strip has been cleaned with my cleaning solution, the steel is rinsed with water and then proceeds to further finishing processes, such as annealing, galvanizing, tin plating and/or other finishing operations.

The cleaning dispersion is also suitable to any type of cleaning operation where a liquid dispersion type cleaner may be employed. For example, in cleaning of irregularly shaped parts that are placed on a conveyor and immersed in a tank of an alkaline cleaner solution, then moved at timed intervals, a dispersion type liquid cleaner displays handling advantages. Also, in spray applications for parts that are too large for tank immersion, a homogeneous dispersion type alkaline liquid cleaner as disclosed hereinbelow may be metered directly into spray equipment eliminating the need to prepare a concentrated solution from a powdered formulation.

The best mode of using my invention will be apparent from a consideration of the following examples:

EXAMPLE 1

A typical dispersion of my invention is shown below:

| Ingredient | Weight (%) |
|---|---|
| Sodium hydroxide solution (50% NaOH) | 84.25 |
| Water | 9.00 |
| Sodium hexametaphosphate | 2.00 |
| Sodium gluconate | 0.50 |
| Tetrasodium ethylenediamine tetraacetic acid | 0.25 |
| Sodium polyacrylate aqueous solution (40% solids) | 1.00 |
| Sodium carbonate | 2.00 |
| Nonionic surfactant | 1.00 |

EXAMPLE 2

This example shows a highly alkaline aqueous cleaning dispersion having a minimum number of additives.

| Ingredient | Weight (%) |
|---|---|
| Sodium hydroxide solution (50% NaOH) | 89.0 |
| Water | 7.0 |
| Sodium polyacrylate aqueous solution (40% solids) | 1.0 |
| Sodium carbonate | 3.0 |

The water, 40% sodium polyacrylate and sodium carbonate are mixed in a separate vessel and agitated until a solution is formed. This premix is then combined with the 50% sodium hydroxide solution in a mixing vessel and agitated until a uniform dispersion is obtained.

EXAMPLE 3

This cleaning dispersion is low in sodium hydroxide content.

| Ingredient | Weight (%) |
|---|---|
| Sodium hydroxide solution (50% NaOH) | 19.00 |
| Water | 47.25 |
| Sodium hexametaphosphate | 10.00 |
| Sodium gluconate | 0.50 |
| Tetrasodium ethylenediamine tetraacetic acid | 0.25 |
| Sodium hydroxide solution (50% NaOH) | 2.00 |
| Sodium polyacrylate aqueous solution (40% solids) | 1.00 |
| Sodium carbonate | 20.00 |

The water, sodium hexametaphosphate, tetrasodium ethylenediamine tetraacetic acid, the 2% by weight of the sodium hydroxide solution, the sodium polyacrylate, and the sodium carbonate are blended in a mixing vessel until a saturated premix solution is formed. The 2% by weight of the sodium hydroxide solution is needed in the premix to bring the pH of the solution to at least 7. The formation of the premix solution is facilitated by heating to approximately 125° F. The premix solution is then combined, with agitation, with the 19% by weight of 50% solids sodium hydroxide solution, and agitated until a uniform dispersion is obtained.

EXAMPLE 4

In this cleaner dispersion, potassium carbonate is the bulking agent.

| Ingredient | Weight (%) |
|---|---|
| Sodium hydroxide (50% solution) | 85.25 |
| Water | 9.00 |
| Sodium hexametaphosphate | 2.00 |
| Sodium gluconate | 0.50 |
| Tetra sodium ethylenediamine tetra-acetic acid | 0.25 |
| Sodium polyacrylate (40% solution) | 2.00 |
| Potassium carbonate | 2.00 |

This formula shows no phase separation after three days at ambient temperature. The same formula prepared without the use of the sodium polyacrylate shows phase separation within 8 hours after preparation.

EXAMPLE 5

The following dispersion uses potassium carbonate as a bulking agent and trisodium phosphate as an alkali metal phosphate builder.

| Ingredient | Weight (%) |
|---|---|
| Sodium hydroxide (50% solution) | 85.25 |
| Water | 9.00 |
| Sodium gluconate | 0.50 |
| Tetra sodium ethylenediamine tetra-acetic acid | 0.25 |
| Trisodium phosphate | 2.00 |
| Sodium polyacrylate (40% solution) | 1.00 |
| Potassium carbonate | 2.00 |

This concentrate displays no phase separation after three days at ambient temperature. This same formula prepared without the use of the sodium polyacrylate displays phase separation within 8 hours after preparation.

EXAMPLE 6

In the following cleaning dispersion trisodium phosphate serves as the bulking agent as well as the alkali metal phosphate builder.

| Ingredient | Weight (%) |
|---|---|
| Sodium hydroxide (50% solution) | 86.25 |
| Water | 9.00 |
| Trisodium phosphate | 3.00 |
| Sodium gluconate | 0.50 |
| Tetra sodium ethylenediamine tetra acetic acid | 0.25 |
| Sodium polyacrylate | 1.00 |

This formula displays no phase separation after 3 days at ambient temperature. This same formula prepared without the use of the sodium polyacrylate displays phase separation within 8 hours after preparation.

I claim:

1. A liquid highly alkaline aqueous cleaning dispersion which resists separation into layers said dispersion containing at least about 40% solids by weight and comprising the following ingredients expressed as percent by weight:

Sodium hydroxide: 10 to 45%

Alkali metal or ammonium salt of polyacrylic acid having a molecular weight within the range of 500 to 12,000: 0.04% to gelling
Alkali metal phosphate builder: 2 to 15%
Nonionic surfactant: 0.3 to 5%
Chelator: 0.25 to 3%
Sodium or potassium carbonate as a bulking agent: 0.5 to 20%
Water: Balance in which the chelator is one or more members selected from group consisting of sorbitol, gluconic acid, glucoheptonic acid, mannitol, ascorbic acid, sorbose, tannic acid, ethylenediamine tetraacetic acid, sodium chrom glucosate, diglycolic acid, aspartic acid, d-gluconolactone, l-rhamnose, nitrilotriacetic acid, and the sodium or potassium salts of the acids.

2. The cleaning dispersion of claim 1 in which the alkali metal or ammonium salt of polyacrylic acid is present at a concentration of 0.04 to 4% by weight.

3. The cleaning dispersion of claim 1 in which the alkali metal phosphate builder is one or more members selected from the group consisting of sodium hexametaphosphate, sodium tripolyphosphate, tetrapotassium pyrophosphate, tetrasodium pyrophosphate, trisodium phosphate, disodium phosphate, monosodium phosphate, monopotassium phosphate, dipotassium phosphate and tripotassium phosphate.

4. The cleaning dispersion of claim 1 in which the alkali metal phosphate builder is sodium hexametaphosphate and the chelator is sodium gluconate.

5. The cleaning dispersion of claim 1 in which the bulking agent is sodium carbonate.

6. The cleaning composition of claim 1 wherein the nonionic surfactant is selected from the group consisting of linear and branch chain ethoxylated alcohols and ethoxylated alkyl and dialkyl phenols.

7. A liquid highly alkaline aqueous cleaning dispersion which resists separation into layers comprising the following ingredients expressed as percent by weight:
Sodium hydroxide aqueous solution (50% NaOH): 84.25%
Sodium salt of polyacrylic acid having a molecular weight within the range of 500 to 12,000 (40% conc.): 1.0%
Sodium hexametaphosphate: 2.0%
Nonionic surfactant: 1.0%
Sodium gluconate: 0.5%
Tetrasodium ethylenediamine tetraacetic acid: 0.25%
Sodium carbonate: 2.0%
Water: 9.0%.

8. A liquid highly alkaline aqueous cleaning dispersion which resists separation into layers comprising the following ingredients expressed as percent by weight:
Sodium hydroxide aqueous solution (50% NaOH): 21.0%
Sodium hexametaphosphate: 10.0%
Sodium gluconate: 0.50%
Tetrasodium ethylenediamine tetraacetic acid: 0.25%
Sodium salt of polyacrylic acid having a molecular weight within the range of 500 to 12,000: 1.0%
Sodium carbonate: 20.0%
Water: 47.25%.

* * * * *